US010932511B2

(12) United States Patent
Van Akin

(10) Patent No.: US 10,932,511 B2
(45) Date of Patent: Mar. 2, 2021

(54) FLIP UP SUNSCREEN FOR BASEBALL HAT

(71) Applicant: Gary C Van Akin, Enfield, CT (US)

(72) Inventor: Gary C Van Akin, Enfield, CT (US)

( * ) Notice: Subject to any disclaimer, the term of this patent is extended or adjusted under 35 U.S.C. 154(b) by 0 days.

(21) Appl. No.: 16/405,360

(22) Filed: May 20, 2019

(65) Prior Publication Data

US 2019/0357616 A1 Nov. 28, 2019

Related U.S. Application Data

(60) Provisional application No. 62/676,055, filed on May 24, 2018.

(51) Int. Cl.
*A42B 1/18* (2006.01)
*A42B 1/0182* (2021.01)
*A42B 1/0184* (2021.01)

(52) U.S. Cl.
CPC ..... *A42B 1/18* (2013.01); *A42B 1/0182* (2021.01); *A42B 1/0184* (2021.01)

(58) Field of Classification Search
CPC ..... A42B 1/062; A42B 1/18; A42B 1/0182; A42B 1/0814
USPC ..... 2/10
See application file for complete search history.

(56) References Cited

U.S. PATENT DOCUMENTS 1,228,341 A * 5/1917 Maynard ..... A42B 1/247 2/10
1,725,340 A * 8/1929 Castriotis ..... A42B 1/247 2/10
2,481,960 A * 9/1949 Wall ..... A42B 1/062 2/10
5,129,102 A * 7/1992 Solo ..... A42B 1/247 2/10
5,689,827 A * 11/1997 Ryder ..... A42B 1/247 2/10
6,174,058 B1 * 1/2001 Hsiao ..... A42B 1/062 2/10
6,237,147 B1 * 5/2001 Brockman ..... A42B 1/247 2/10
6,237,156 B1 * 5/2001 Ellman ..... A42B 1/064 2/10
6,491,390 B1 * 12/2002 Provost ..... A42B 1/247 2/10
8,631,512 B2 * 1/2014 Stachler ..... A42B 3/185 2/10
D833,121 S * 11/2018 Darby ..... D2/891
2009/0013439 A1 * 1/2009 Thoman ..... A61F 9/02 2/10
2009/0094720 A1 * 4/2009 Stachler ..... A61F 9/029 2/5
2009/0229028 A1 * 9/2009 Dobkins ..... A42B 1/247 2/10
2009/0307816 A1 * 12/2009 Stachler ..... A42B 3/185 2/10
2009/0307817 A1 * 12/2009 Stachler ..... A42B 3/185 2/10
2009/0307818 A1 * 12/2009 Stachler ..... A42B 3/185 2/10

(Continued)

*Primary Examiner* — Anne M Kozak
(74) *Attorney, Agent, or Firm* — Robert S. Smith

(57) ABSTRACT

A sun screen apparatus which includes apparatus for mounting on the visor of a so-called baseball cap that includes a planar translucent member carried on the apparatus for mounting that allows movement of the planar member between horizontal and vertical positions.

1 Claim, 5 Drawing Sheets

(56) References Cited

U.S. PATENT DOCUMENTS

| | | | | |
|---|---|---|---|---|
| 2012/0005795 | A1* | 1/2012 | Tilley | A42B 3/227 2/10 |
| 2015/0189938 | A1* | 7/2015 | Reinhart | A42B 1/205 2/195.2 |
| 2018/0206573 | A1* | 7/2018 | Hall | A42B 1/064 |
| 2019/0021430 | A1* | 1/2019 | Elliott | A42B 1/062 |
| 2019/0150551 | A1* | 5/2019 | Clark | A42C 5/04 |

* cited by examiner

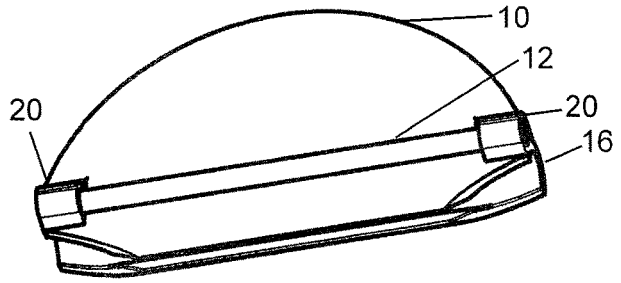
FIG. 8
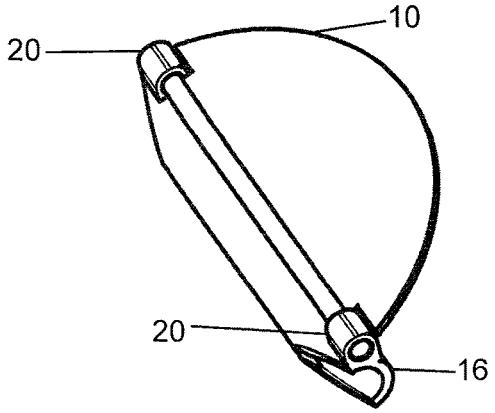
FIG. 11
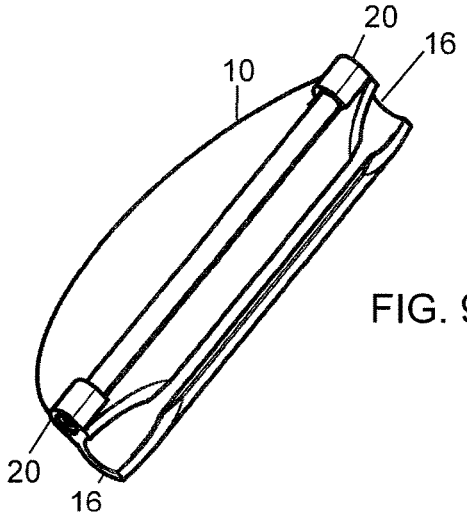
FIG. 9
FIG. 10
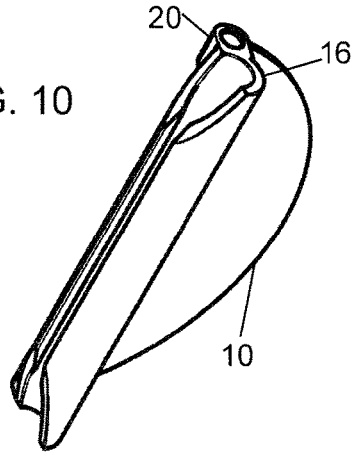

FLIP UP SUNSCREEN FOR BASEBALL HAT

CROSS-REFERENCE TO RELATED APPLICATIONS

This application is a continuation of U.S. provisional application 62/676055 filed May 24, 2018. That application is hereby incorporated herein by reference in its entirety.

TECHNICAL FIELD

The present invention is generally directed to sun protection apparatus. More particularly, the present invention is directed to such apparatus that cooperates with a hat. More particularly, the present invention is directed for use with a baseball cap that utilizes a stiff visor to protect the user's eyes from the sun. The present application uses the term "visor" to describe the part of the hat that is generally intended to protect the user's eyes from the sun. Those skilled in the art will recognize that the terms "bill", "brim", or "peak" may also be used for the same part of the cap.

Even more particularly, the present invention is directed to apparatus for attachment to the brim of a baseball hat and which may be selectively flipped up or down.

BACKGROUND OF THE INVENTION

The conventional baseball hat provides some protection from the glare of the sun's rays. However, there are many times when that protection is not adequate. For example, when the sun is very low in the sky the visor of the hat is inadequate to shield the eyes of the person wearing the hat.

From the above, it is therefore seen that there exists a need in the art to overcome the deficiencies and limitations described herein and above.

Accordingly, it is an object of the present invention to provide apparatus that can be readily moved between a protective position and stored to accommodate variations in the position of the sun as well as the user.

It is another object of the present invention to provide apparatus which in some embodiments can be readily moved from one baseball hat to another.

It is yet another object of the present invention to provide a tinted portion which may in some cases include advertising matter that will be visible to persons that are close to the user of the apparatus.

It is a still further object of the present invention to provide apparatus that is very inexpensive to manufacture.

It is still another object of the present invention to provide some embodiments of the apparatus that are very easy to install on a baseball cap.

Additional features and advantages are realized through the techniques of the present invention. Other embodiments and aspects of the invention are described in detail herein and are considered a part of the claimed invention.

The recitation herein of desirable objects which are met by various embodiments of the present invention is not meant to imply or suggest that any or all of these objects are present as essential features, either individually or collectively, in the most general embodiment of the present invention or in any of its more specific embodiments.

From the above, it is therefore seen that there exists a need in the art to overcome the deficiencies and limitations described herein and above.

SUMMARY OF THE INVENTION

The shortcomings of the prior art are overcome and additional advantages are provided through a sun screen apparatus which includes apparatus for mounting on the visor of a so-called baseball cap that includes a planar translucent member carried on the apparatus for mounting that allows movement of the planar member between horizontal and vertical positions. In some embodiments the planar translucent member has a circumferential shape that includes an arc and a straight line. The arc and said straight line in some embodiments coincide with respectively the circumference and a diameter of a disc of translucent material. The translucent material may be polycarbonate.

Other embodiments include a sunscreen apparatus which includes a mounting apparatus comprising any elongated sleeve shape cylindrical body, said body has an axially extending slot, said slot is dimensioned and configured for receiving the associated visor of an associated baseball cap, said body including $1^{st}$ and $2^{nd}$ spaced apart journal bearings that are coaxially disposed. The apparatus also includes a substantially planar translucent sunscreen member. The member has an axle fixed to the member that is dimensioned and configured for being received in said $1^{st}$ and $2^{nd}$ spaced apart journal bearings whereby said translucent member is pivotable with respect to said body to a plurality of positions including but not limited to a vertical position to block horizontal sunlight rays.

In some embodiments the sunscreen apparatus the elongated sleeve shape cylindrical body has tapered axial extremities to facilitate insertion of the visor of a baseball cap into said elongated sleeve shape cylindrical body.

Still other embodiments of the present invention include a baseball hat to which one or more of the sunscreen apparatus in accordance with the present invention are permanently attached to the visor.

Additional features and advantages are realized through the techniques of the present invention. Other embodiments and aspects of the invention are described in detail herein and are considered a part of the claimed invention.

The recitation herein of desirable objects which are met by various embodiments of the present invention is not meant to imply or suggest that any or all of these objects are present as essential features, either individually or collectively, in the most general embodiment of the present invention or in any of its more specific embodiments.

BRIEF DESCRIPTION OF THE DRAWINGS

The subject matter which is regarded as the invention is particularly pointed out and distinctly claimed in the concluding portion of the specification. The invention, however, both as to organization and method of practice, together with the further objects and advantages thereof, may best be understood by reference to the following description taken in connection with the accompanying drawings in which:

FIG. 8 is an isometric view of an assembly of the sunscreen, shaft and support, FIG. 9 is another isometric view of an assembly of the sunscreen, shaft and support, FIG. 10 is another isometric view of an assembly of the sunscreen, shaft and support, FIG. 11 is another isometric view of an assembly of the sunscreen, shaft and support.

DETAILED DESCRIPTION

Figure 3:
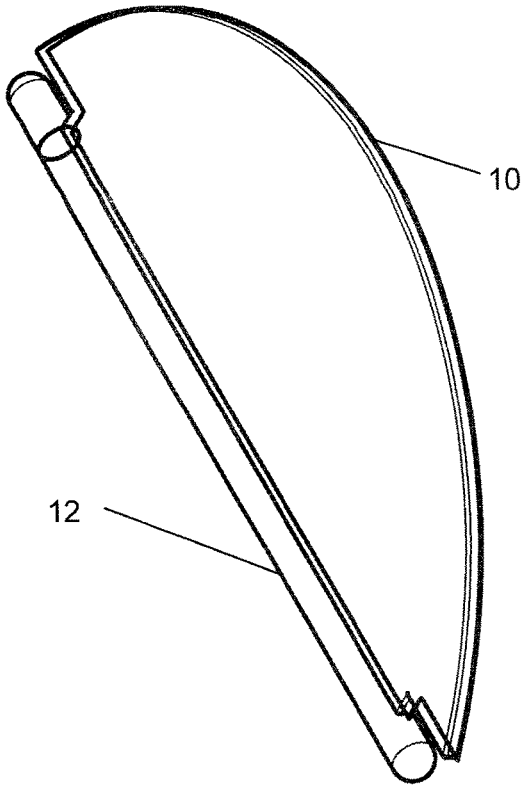
FIG. 3 is an isometric view of the sunscreen and shaft shown in FIG. 1.
Figure 2:
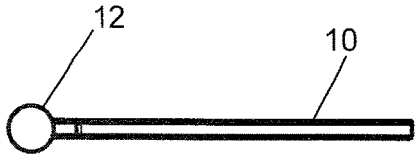
FIG. 2 is an end view of the sunscreen and shaft shown in FIG. 1.
Figure 1:
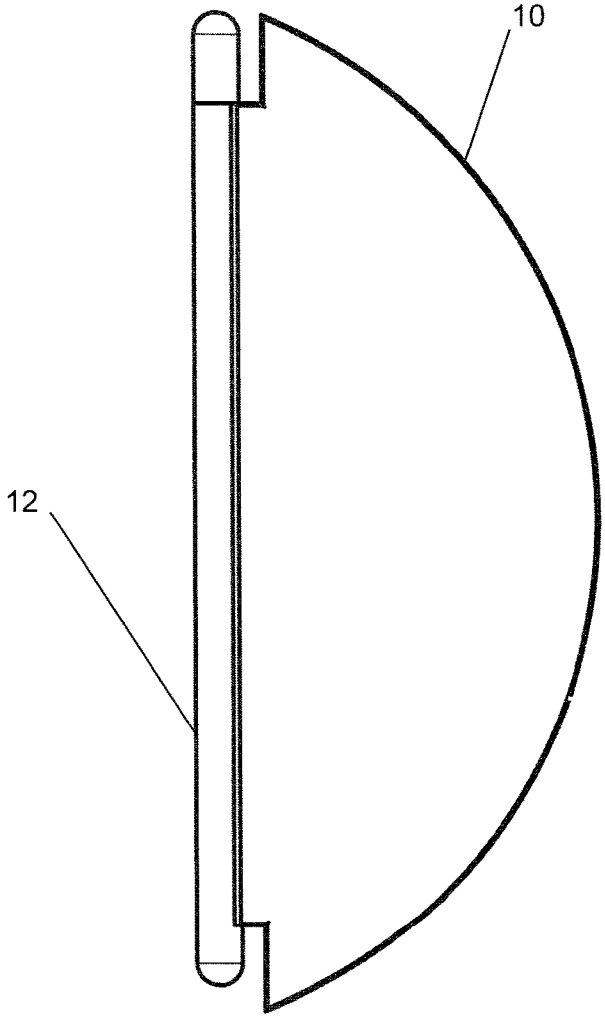
FIG. 1 is a side view of a sunscreen fixed to a mounting shaft in accordance with one form of the present invention.

As best seen in FIGS. Also 1-7, one form of the present apparatus in accordance with the present invention includes a translucent sunscreen 10 all that is fixed to an elongated the axle 12. The elongated axle 12 cooperates with a mounting bracket 14. The mounting bracket 14 in one embodiment is an elongated rectilinear sleeve having elongated rectilinear slot 18 therein. The slot 18 has opposed sides that are dimensioned and configured for frictionally engaging opposed sides of the visor of a baseball hat. The bracket 14 further includes two spaced journal bearings 20 dimensioned and configured for receiving the axial extremities of the axle 12.

As best illustrated in FIGS. 8-10 the sunscreen 10 carried by the axle 12 engages the journal bearings 20 in the bracket 14. Frictional engagement between the journal bearings 20 in the axle 12 causes the sunscreen 10 to remain in an angular position with respect to the bearings 20 after a user selects a particular angular relationship.

Figure 6:
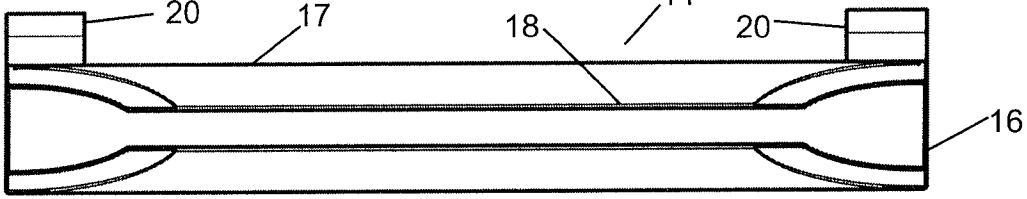
FIG. 6 is a bottom view of the support shown in FIG. 4.
Figure 12:
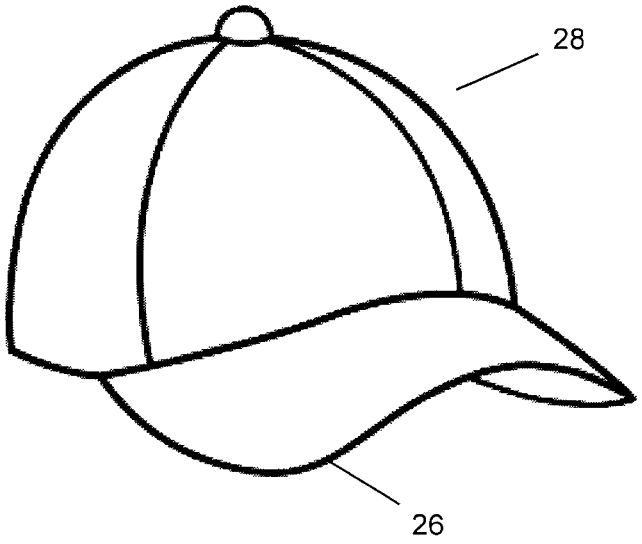
FIG. 12 is an isometric view of a baseball cap suitable for either temporary or permanent installation of the sunscreen, shaft and support.
Figure 13:
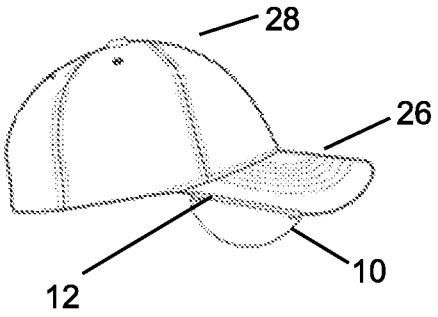
FIG. 13 is an isometric view of a baseball hat having the assembly of the sunscreen, shaft and support installed on the side edge of the brim of the baseball hat with sunscreen positioned vertically to block sunrays extending toward the right side of a person wearing the hat.
Figure 14:
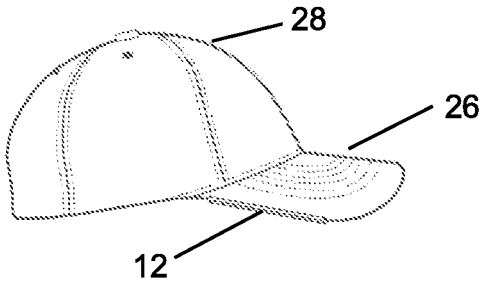
FIG. 14 is an isometric view of a baseball hat having the assembly of the sunscreen, shaft and support installed on the side edge of the brim of the baseball hat with the sunscreen positioned horizontally for occasions when no sun screen is required.

As best seen in FIGS. 6, 9 and 10 the axial extremities of the elongated rectilinear sleeve 17 and the elongated rectilinear slot are tapered to facilitate insertion of the visor 26 of the baseball cap 28 into the elongated rectilinear slot 18.

In some extreme situations a sunscreen in accordance with the present invention may even be used at the outermost portion of the baseball hat peak. For example, some roads be may be both very congested and positioned in perfect alignment with a setting sun forcing a driver to inch forward with essentially no visibility. The present invention satisfies an important need for such situations.

Figure 4:
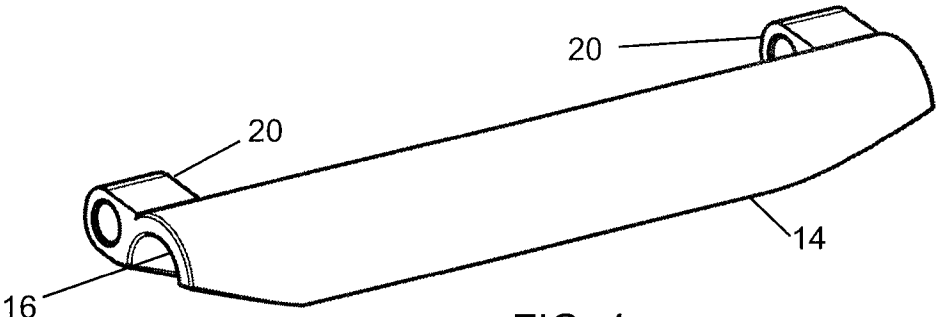
FIG. 4 is an isometric view of a support for supporting the sunscreen and shaft shown in FIG. 1.
Figure 5:
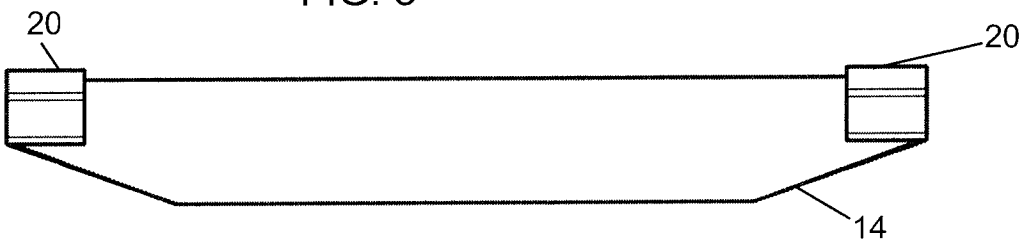
FIG. 5 is top view of the support shown in FIG. 4.
Figure 7:
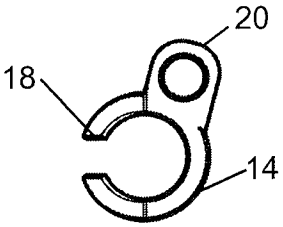
FIG. 7 is an end view of the support shown in FIG. 4.

In some embodiments the sunscreen is clamped on the side of the associated visor. In a prototype version the clamp or supports are so-called binder clips which extend through elongated apertures in the sunscreen and engage the side of the visor. Accordingly, the sunscreen may be flipped down as shown in FIG. 4 all time may be folded up when there is no need for the protection from the sun.

It will be understood that the identical apparatus may be used on both sides of visor in some embodiments of the present apparatus. The illustrated embodiment of the apparatus using the identical apparatus has the advantage of simplifying the manufacturer and providing economies of scale in the manufacture of the single uniform apparatus. More particularly, the illustrated "half-moon" shape illustrated herein provides operating clearance as the sunscreen is moved between (1) a stored position in which the sunscreen is stored in space abutting relationship to the face of a brim of an associated baseball hat and (2) a deployed position in which the sunscreen is positioned in substantially perpendicular relationship to the brim of the associated baseball hat.

In other embodiments the shape of the sunscreen may be different on the respective left and right sides of the brim of the associated baseball. Such embodiments may provide greater surface area and more protection for the eyes of the user of the apparatus; however, such other embodiments eliminate the possibility of identical parts usable on either side of the brim. Thus, there are advantages to each of the potential embodiments of the present invention.

More particularly, some environmental conditions will make it desirable to have both sides flipped down simultaneously. In other cases, only one side will be flipped down at a time. In some extreme situations a sunscreen in accordance with the present invention may even be used at the outermost portion of the baseball hat peak. For example, some roads be may be both very congested and positioned in perfect alignment with a setting sun forcing a driver to inch forward with essentially no visibility. The present invention satisfies an important need for such situations.

In many embodiments, the sunscreen will be manufactured of polycarbonate. The color of the tinting will vary for different application. It will be understood that when the sunscreen is not in use it can be flipped up and will not interfere with the vision of the user.

The apparatus in accordance with the present invention does not ordinarily touch the face of the user and does not interfere with glasses that may be concurrently utilized by the user.

Accordingly, it will be seen that the apparatus of the present invention provides ultraviolet light protection without compromising the vision of the user. More particularly this is particularly significant in low light conditions when a sunscreen that is directly over the eyes of the user would severely impact the user's vision.

Although the description herein describes journal bearings that are part of a body that is attached to the brim of a baseball cap which cooperates with a shaft attached to a translucent member, those skilled in the art will recognize that other embodiments invention will reverse that relationship. Similarly, those skilled in the art will recognize that such a reversal is fully equivalent to and part of the present invention.

Similarly, the description of the present invention illustrates a single elongated axle for cooperates with 2 journal bearings. Those skilled in the art will recognize that just as a car may have a single axle joining, for example, the rear wheels, the front wheels, for example, may be mounted on first and second stub axles. Embodiments of the present invention having a single axle will typically be dimensioned and configured whereby the axle may be bent sufficiently to allow the axial extremities thereof to be inserted into the respective journal bearings.

Some embodiments of the present invention include an assembly of a baseball cap, the sunscreen, shaft and support that are permanently fixed together. Other embodiment may permanently include a second sunscreen, a second shaft and shaft and support. Still other embodiments include assemblies of the sunscreen, shaft and support. One or more such assemblies may be utilized by the user on a baseball cap of the user's choice. Accordingly, the user may attach one, two or even more such assemblies comprising a sunscreen, shaft and support as desired by the user. The user may carry such assemblies, for example in his or her pocket and attach to the baseball cap chosen to be worn at any selected time.

All publications and patent applications mentioned in this specification are indicative of the level of skill of those skilled in the art to which this invention pertains. All publications and patent applications are herein incorporated by reference to the same extent as if each individual publication or patent application was specifically and individually indicated to be incorporated by reference.

It will be understood that, in general, terms used herein, and especially in the appended claims, are generally intended as "open" terms (e.g., the term "including" should be interpreted as "including but not limited to," the term "having" should be interpreted as "having at least," the term "includes" should be interpreted as "includes but is not limited to," etc.). It will be further understood that if a specific number of an introduced claim recitation is intended such an intent will be explicitly recited in the claim, and in the absence of such recitation no such intent is present. For example, as an aid to understanding, the following appended claims may contain usage of introductory phrases such as "at least one" or "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "an imager" should typically be interpreted to mean "at least one imager"); the same holds true for the use of definite articles used to introduce claim recitations. In addition, even if a specific number of an introduced claim recitation is explicitly recited, it will be recognized that such recitation should typically be interpreted to mean at least the recited number (e.g., the bare recitation of "two images," or "a plurality of images," without other modifiers, typically means at least two images). Furthermore, in those instances where a phrase such as "at least one of A, B, and C," "at least one of A, B, or C," or "an [item] selected from the group consisting of A, B, and C," is used, in general such a construction is intended to be disjunctive (e.g., any of these phrases would include but not be limited to systems that have A alone, B alone, C alone, A and B together, A and C together, B and C together, or A, B, and C together, and may further include more than one of A, B, or C, such as $A_1$, $A_2$, and C together, A, $B_1$, $B_2$, $C_1$, and $C_2$ together, or $B_1$ and $B_2$ together). It will be further understood that virtually any disjunctive word or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

Although the description above contains many specifics, these should not be construed as limiting the scope of the invention, but as merely providing illustrations of some of the presently preferred embodiments of this invention. Thus, the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. Sunscreen apparatus which comprises:

a mounting apparatus comprising an axially elongated sleeve shaped body having a rectilinear axis, said body having an axially extending slot, said slot being dimensioned and configured for receiving either side edge of an associated visor of an associated baseball cap, said body including $1^{st}$ and $2^{nd}$ spaced apart journal bearings that are mutually coaxially disposed and a planar translucent sunscreen member, said member having an axle fixed to said member that is dimensioned and configured for being received in said $1^{st}$ and $2^{nd}$ spaced apart journal bearings whereby said translucent member is pivotable with respect to said body to a plurality of positions including but not limited to a vertical position to block horizontal sunlight rays, said axially elongated sleeve shaped body has tapered axial extremities to facilitate insertion of the visor of a baseball cap into said axially elongated sleeve shaped body.

* * * * *